US005570557A

United States Patent [19]

Kwiatkowski et al.

[11] Patent Number: 5,570,557

[45] Date of Patent: Nov. 5, 1996

[54] SNOW STOP ROOFING WITH PROTRUSION AND/OR WEDGE SNOW STOP

[76] Inventors: Janusz Kwiatkowski, 68 Hillside Dr., Revere, Mass. 02151; Michael J. Mullane, 17 Mason St., Hudson, Mass. 01749

[21] Appl. No.: 417,104

[22] Filed: Apr. 5, 1995

[51] Int. Cl.[6] ..... E04C 2/32

[52] U.S. Cl. ..... 52/630; 52/26; 248/237

[58] Field of Search ..... 52/24, 26, 630; 248/237, 148, 223.41, 224.51; 428/136, 134, 167, 156

[56] References Cited

U.S. PATENT DOCUMENTS

| | | | |
|---|---|---|---|
| 2,191,383 | 2/1940 | Haswell | 52/630 |
| 2,270,537 | 1/1942 | Ludington | 52/24 X |
| 3,011,289 | 12/1961 | Ochiltree | 52/630 X |
| 3,669,051 | 6/1972 | Conway et al. | 248/237 |
| 3,703,432 | 11/1972 | Koski | 428/134 X |
| 4,109,438 | 8/1978 | De la Concha | 52/630 |
| 4,579,785 | 4/1986 | Karoubas | 52/334 X |
| 5,020,295 | 6/1991 | Haines et al. | 52/630 |
| 5,152,107 | 10/1992 | Strickert | 52/24 |
| 5,205,088 | 4/1993 | Mueller | 52/24 |
| 5,371,979 | 12/1994 | Kwiatkowski et al. | 52/24 |

FOREIGN PATENT DOCUMENTS

| | | | |
|---|---|---|---|
| 57771 | 1/1924 | Sweden | 52/24 |

OTHER PUBLICATIONS

Cline et al., "Snow Guards, Are They Really Optional?" *Roofer Magazine,* Jan. 1995, pp. 20–21.

M. J. Mullane Co., "Cast Snow & Ice Guards," Brochure, Jun. 1994, back page.

*Primary Examiner*—Lanna Mai

*Attorney, Agent, or Firm*—Christopher John Rudy

[57] ABSTRACT

A roofing system has a sheet surface which may include standing ridges or batten ridges, and the sheet surface has a predetermined arrangement of three dimensional features in addition to the standing ridges or the batten ridges. A snow stop may be installed in conjunction therewith, and may have lower protrusions which may be generally complimentary thereto and/or a snow wedge so as to further help keep it from being disengaged by typical shear and/or peel forces after installation. Thus, for example, as with aluminum or steel standing seamed roofs, added fence type snow guards with their brackets and so forth can be avoided, and/or individual snow stops can be installed so as to have greatly increased holding power to the roofing surface, even in notable cases when applied by underskilled workers.

12 Claims, 4 Drawing Sheets

SNOW STOP ROOFING WITH PROTRUSION AND/OR WEDGE SNOW STOP

FIELD

The invention concerns roofing and/or snow stops.

BACKGROUND

Common metal roofing systems, which are becoming increasingly popular in all parts of the U.S.A., are slippery when wet, and provide little friction to prevent the falling of accumulated ice and snow. The metals typically used for roofing are copper, aluminum and steel.

Snow guards or snow stops may be applied to roofs, to include such metal roofs. See e.g., U.S. Pat. No. 5,371,979 (Dec. 13, 1994) to Kwiatkowski et al. Snow stops for the copper roofs are advantageously applied by soldering.

The aluminum and steel roofs, however, are typically treated with an epoxy primer, and then given a painted finish to enhance their appearance and prevent the metal from corroding. The surface is commonly a polyvinylfluoride (PVF) or similar material, a common PVF brand being Kynar (Reg. U.S. Pat. & Tm. Off.). In general, such roofing is installed in panels, and the panels are processed from rolls, typically one to three feet (0.3048 to 0.9144 m) in width. The edges are bent and formed to join together and form seams, called standing or batten seams. It is at the seams where the panels are fastened to the roofing substrate, which allows the panels to move with thermal expansion and contraction. As the roofing fasteners are covered by the seam, there are no penetrations to let in water or other elements in general.

With the roofs of aluminum or steel and standing or batten seams, two means of snow slide prevention are known.

One is a fence type means, which typically attaches to the seams with some clamping device. It typically has brackets at the seams, which support pipes positioned parallel to the eaves of the roof, which act as a fence to prevent the snow from falling.

The other type of system involves the application of a number of individual snow guards or snow stops, which are spaced over the roof surface to keep the snow from starting to slide. For example, snow stops of this category are commercially available from the M.J. MULLANE CO., Hudson, Mass., Model Nos. 40 & 90. To avoid penetration of the roofing panels by mechanical fasteners such as nails, staples, screws, rivets, and so forth, such snow stops are most popularly applied by means of adhesives.

A problem in the art is that the snow guards or snow stops can fall off for a number of reasons. These include improper adhesive application, not putting enough guards or stops on the roof to support the snow load, and degradation of the adhesive as from air, heat and/or UV-radiation.

What is lacking and needed in the art are ways and means to overcome such problems. Desirably, any solution to the problem would be simple in construction and application.

SUMMARY

The present invention provides a roofing system comprising a sheet with a sheet surface which may include standing or batten ridges wherein the sheet surface has a predetermined arrangement of three dimensional features in addition to the standing or batten ridges. A lower protrusion and/or snow wedge containing snow stop, which may be complimentary thereto, is provided as well.

The invention is useful in buildings construction.

Significantly, one or more problems in the art are ameliorated, solved or avoided. For example, with aluminum or steel batten seamed roofs, added snow guards to include both of the fence type and of the individual type may be avoided, and/or individual snow stops can be installed so as to have greatly increased holding power to the roofing surface, even perhaps when applied by underskilled workers.

Numerous further advantages attend the invention.

DRAWINGS

The drawings form part of the specification hereof. In the drawings, where like numerals refer to like features, the following is briefly noted.

FIG. 2 is a perspective view of the like.

ILLUSTRATIVE DETAIL

Figure 1:
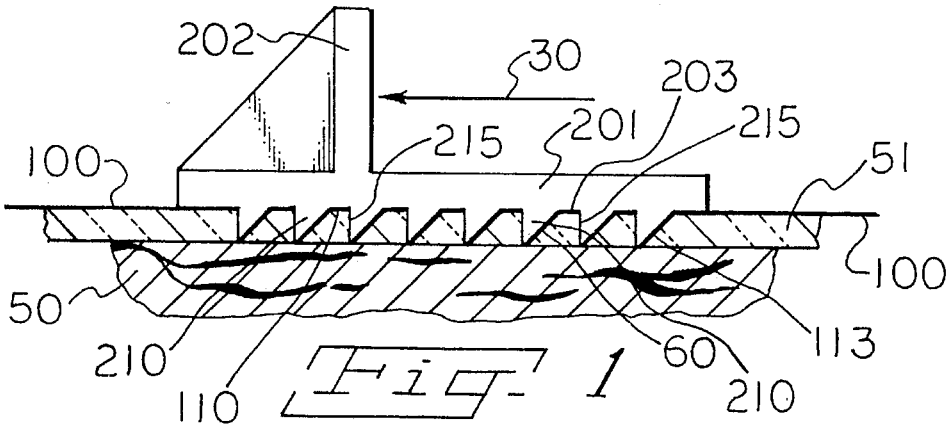
FIG. 1 is a part sectional view of snow stop roofing of the invention with a snow stop of the invention installed.
Figure 2:
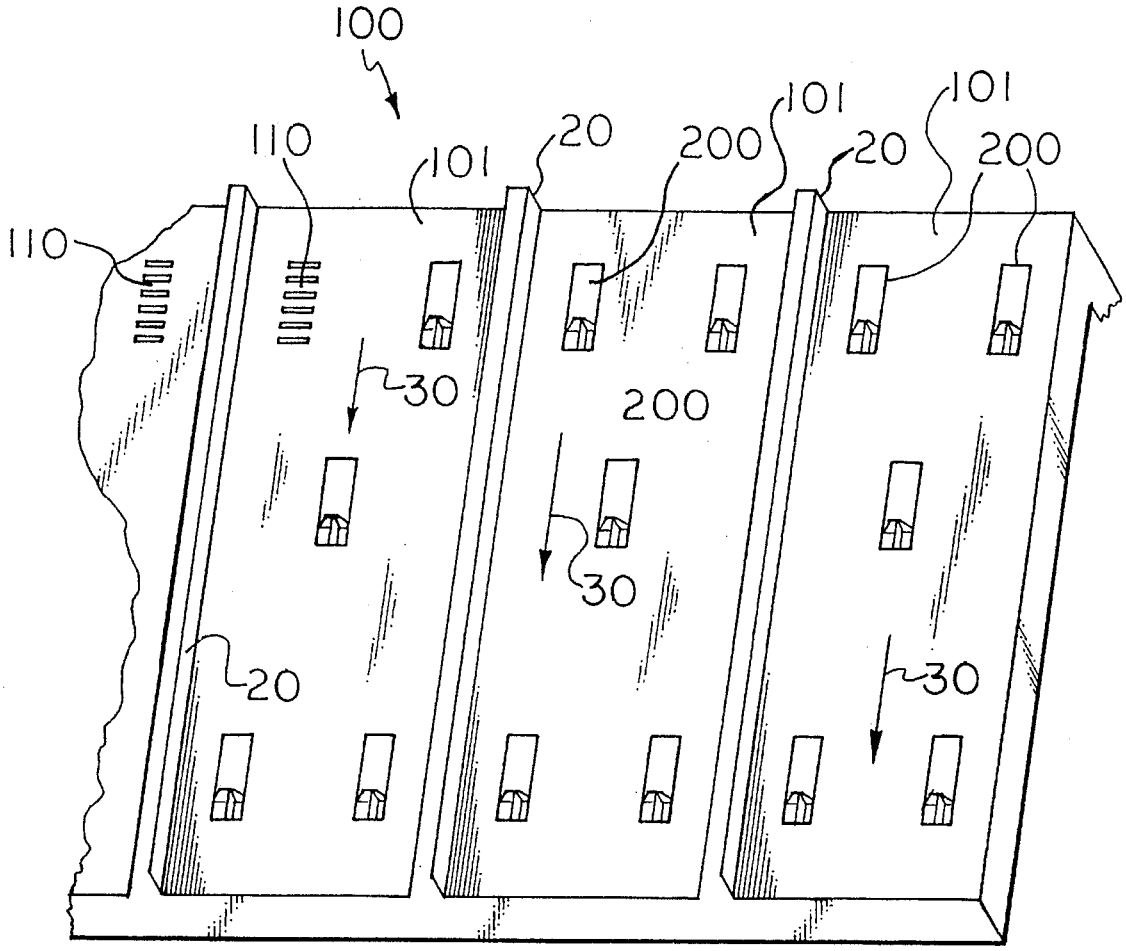

The invention is further understood by reference to particular embodiments and to the drawings of the invention, which are not to be construed as necessarily limiting.

In reference to the drawings, snow stop roofing 100 has a sheet surface 101 and three dimensional features 110 which are for stopping snow themselves and/or supporting a snow stop, include known snow stop models 40 & 90 and protrusion containing snow stop 200 of the invention. As an option, roofing 100 may have standing or batten ridges 20. If such ridges 20 are present the three dimensional features 110 are present in addition to the ridges 20. The arrangement of the three dimensional features 110 is predetermined to help stop snow and/or support the snow stop. Only one three dimensional feature 110 may be required to provide support to a snow stop, for example, snow stop 40, 90 or 200.

The three dimensional features 110 may be upraised 111 and/or indented 112 in relation to the sheet surface 101. A sawtooth pattern 113, as viewed from the side, may be employed, and it itself may have features which are not only above but also below the sheet surface 101 as in up-down sawtooth pattern 114.

Figure 5:
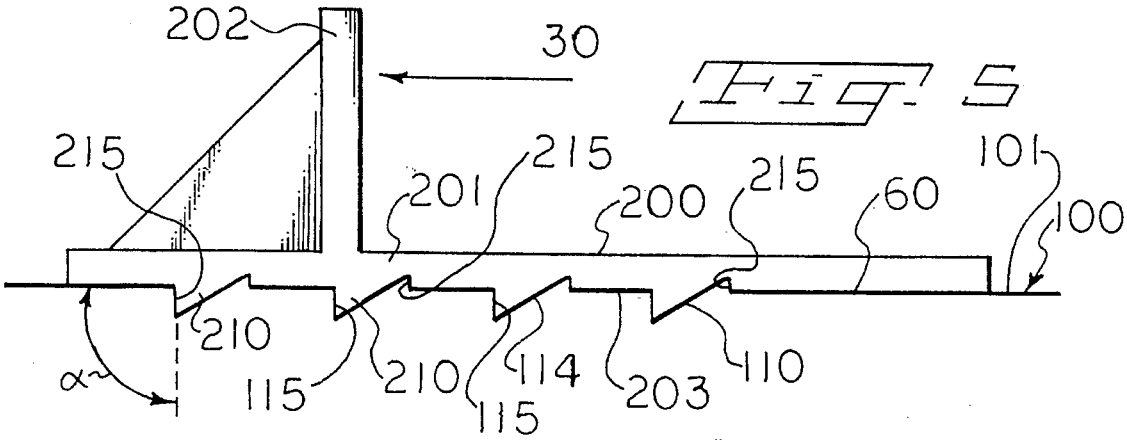
FIG. 5 is a side view of another embodiment of snow stop roofing with a snow stop hereof.
Figure 7:
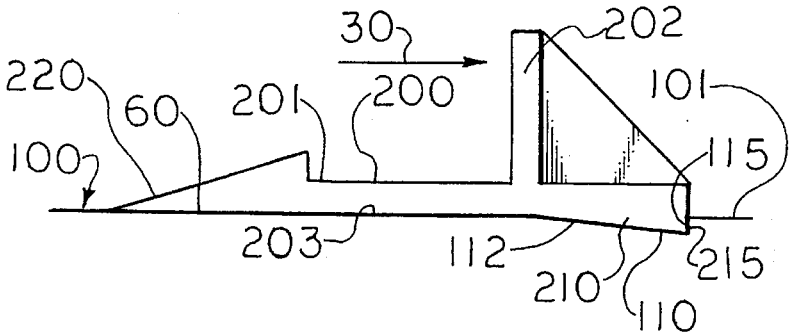
FIG. 7 is a side view of another embodiment of snow stop roofing with a wedge snow stop hereof.
Figure 6:
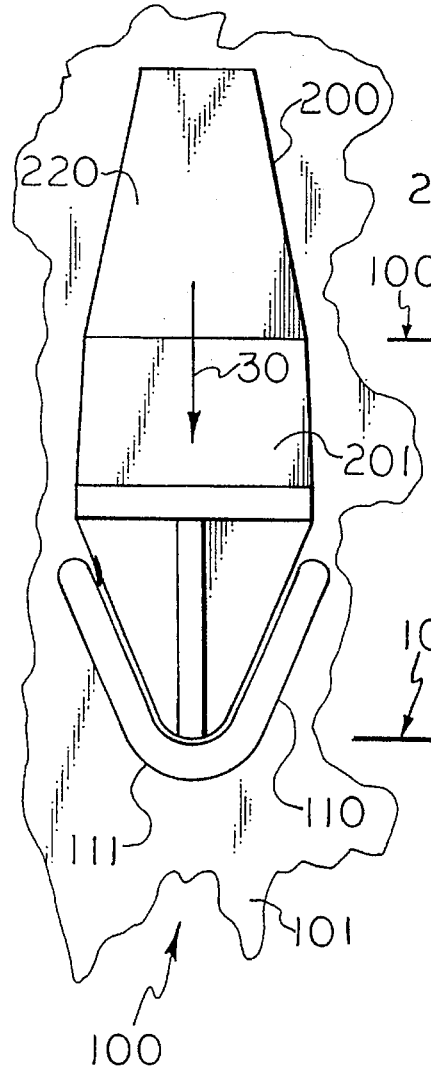
FIG. 6 is a top view of another embodiment of snow stop roofing with a snow stop of the invention having a wedge.
Figure 8:
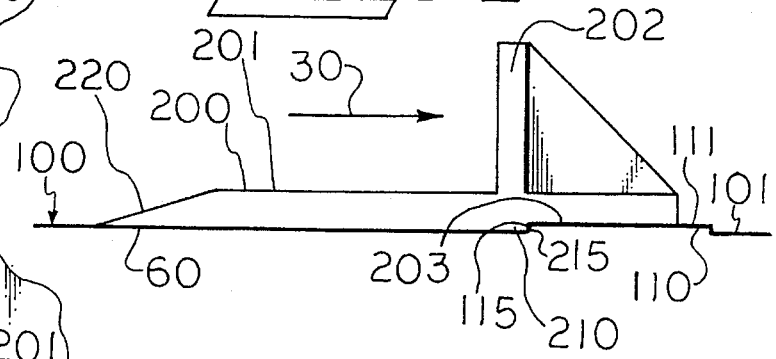
FIG. 8 is a side view of another embodiment of snow stop roofing with a wedge snow stop hereof.
Figure 9:
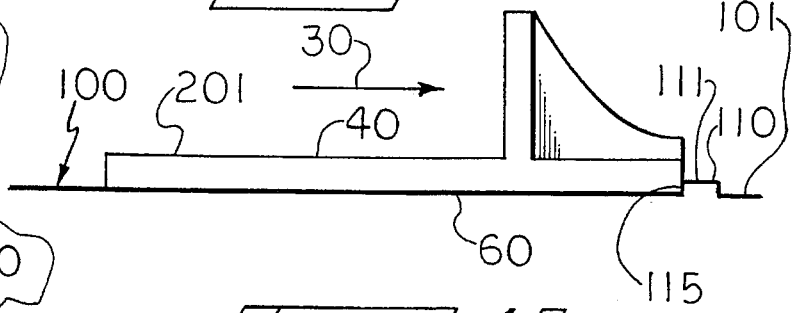
FIG. 9 is a side view of another embodiment of snow stop roofing hereof in place with a snow stop.
Figure 10:
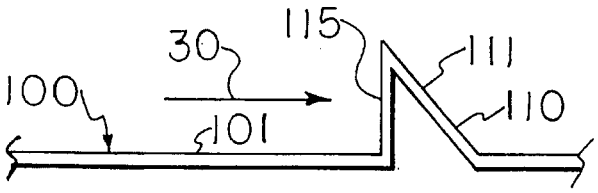
FIG. 10 is a side view of another embodiment of snow stop roofing of the invention.
Figure 11:
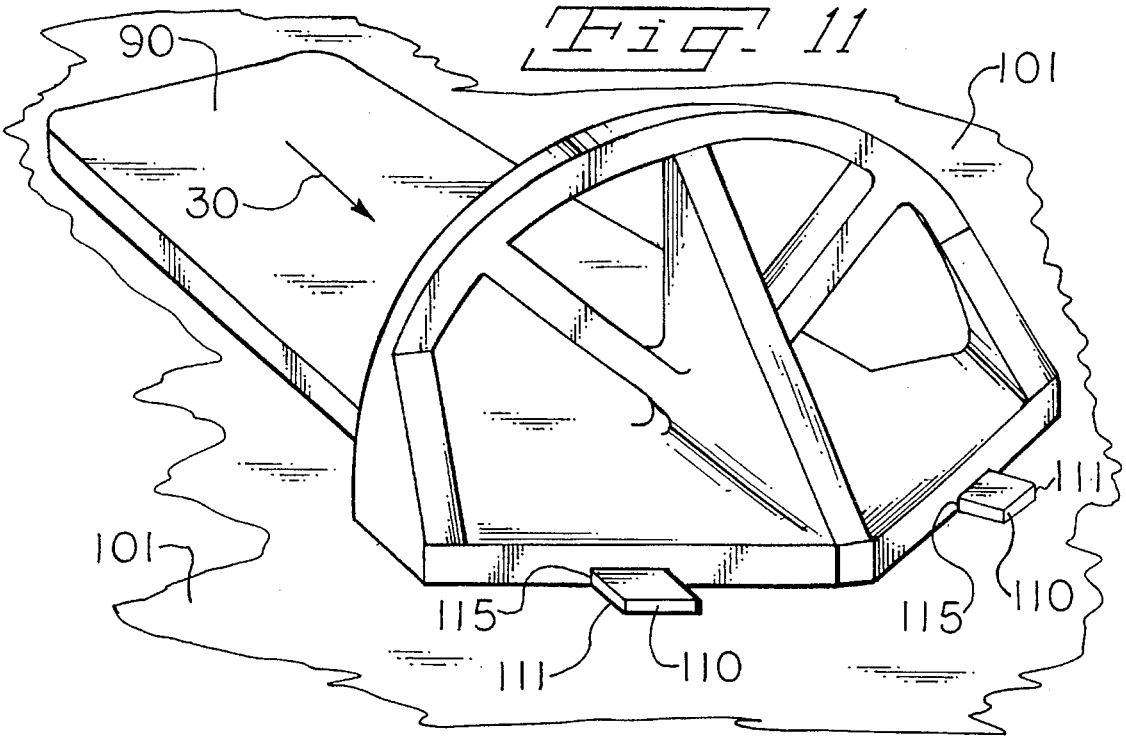
FIG. 11 is a rear, perspective view of another embodiment of snow stop roofing hereof in place with a snow stop.
Figure 12:
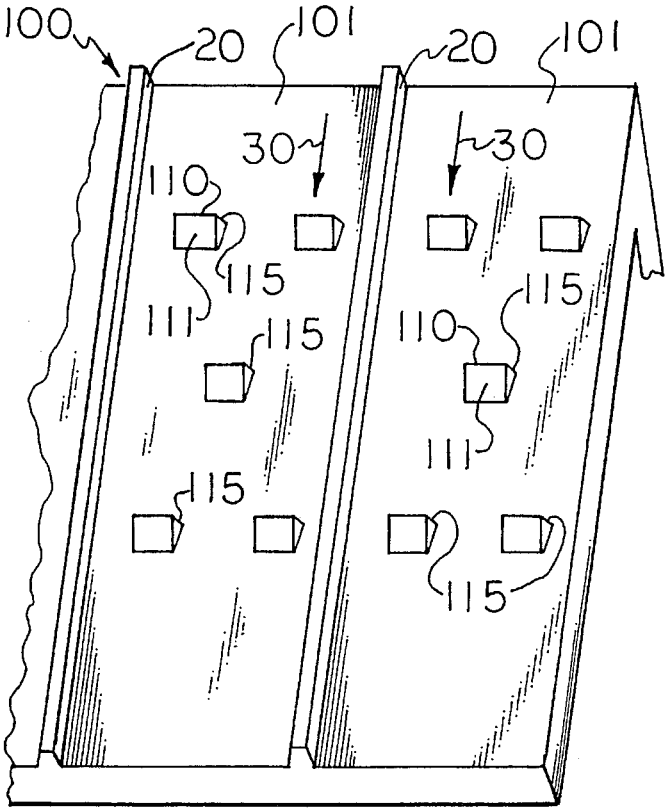
FIG. 12 is a top view of another embodiment of snow stop roofing of the invention.
Figure 13:
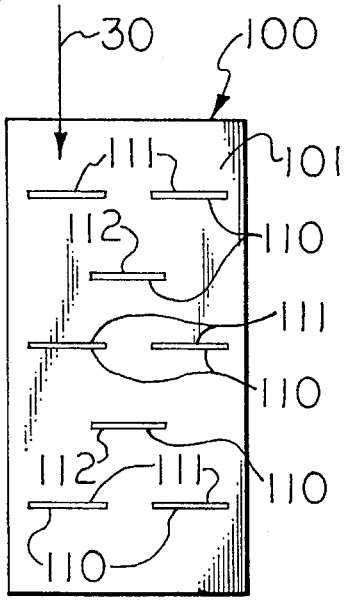
FIG. 13 is perspective view of another embodiment of snow stop roofing of the invention.

A substantially orthogonal surface 115 with respect to the sheet surface 101 may be present within the three dimensional features 110. Note, angle alpha (α) as in FIG. 5 would be about 90 degrees. Preferably, such an orthogonal surface 115 is provided so as to present the surface 115 to face the upward portion of the roofing 100 when installed. Thus, such an orthogonal surface 115 would face direction of force of snow 30 to provide for a static snow stopping device and/or provide for a secure brace for installing the snow stop, to include the snow stops 40, 90 & 200.

Figure 4:
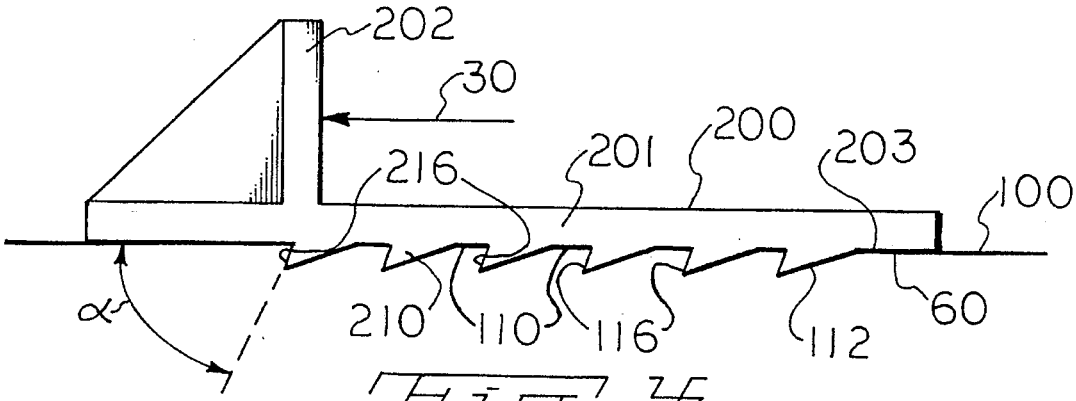
FIG. 4 is a side view of another embodiment of snow stop roofing with a snow stop having acutely angled protrusions thereof.

Alternatively, an acutely angled surface 116 with respect to the sheet surface 101 may be present within the three dimensional features 110. Note, angle alpha (α) as in FIG. 4 would be less than about 90 degrees. In general, such an acutely angled surface 116 is provided so as to present the surface 116 to face the upward portion of the roofing 100 when installed. Thus, such an acutely angled surface 116 would face direction of force of snow 30 to provide for a static snow stopping device and/or provide for a secure brace for installing the snow stop, to include the snow stops 40, 90 & 200, but most especially a snow stop of the invention having corresponding acutely angled protrusions as depicted, for example, in FIG. 4.

The snow stop roofing of the invention may be made of any suitable material, to include of suitable plastics to include epoxies, polyurethanes, and polyolefins; fiber reinforced plastic composites such as epoxy impregnated glass fiber composites; and suitable metals such as copper, aluminum or steel. Preferably, the roofing is of sheet metal, especially of aluminum or steel.

The three dimensional features required by the invention may be made by any suitable method, to include by known methods, to include molding, shaping, milling, bending, pressing, and stamping. This may be accomplished at the plant or mill, and/or on-site, as for example, with sheet metal by heat treating and stamping, and/or cold forming and stamping.

Figure 3:
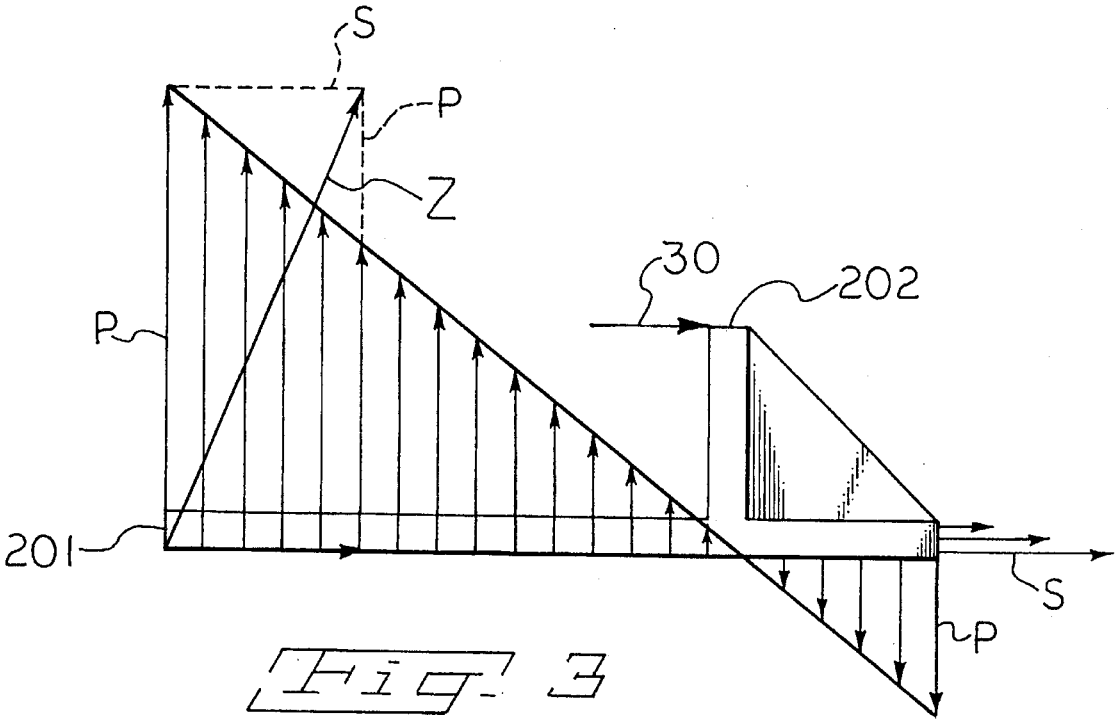
FIG. 3 is a stress vector diagram for a snow stop.

A stress diagram in depicted in FIG. 3 with typical, ideal peel (P) and shear (S) forces for a snow stop. With a force provided from snow or ice in the direction of the force from the snow 30, in general, simple terms, the net or reduced stress (Z) is equal to the square root of the sum of the square of the shear force (S) plus the square of the peel force (P). In mathematical terms, this would follow the general equation:

$$Z=\sqrt{S^2+P^2}\ .$$

Concluding from the ideal situation that if, for example, the shear stress (S) is zero, as would generally be the case where a separately applied snow stop is suitably butted up against a three dimensional feature 110, the net stress (Z) would be in the form of peel stress (P) which may have ramifications in possible selection of a separately applied snow stop and/or adhesive to accompany the roofing hereof. In practice, however, it may be considered that peel stress (P) is reduced in reducing shearing stress (S), especially if it is reduced to zero. Nevertheless, with the typical, horizontal shearing stress (S) reduced to zero as by butting up the snow stop to the three dimensional feature 110, the typical peel stress (P) generally increases. Even so, by reducing such horizontal shearing, loss of structure in the adhesive 60 is in general prevented, since when the adhesive structure is broken by the typical shearing process, the resistance to peeling in general rapidly decreases.

The snow stop which may be complimentary thereto can be one such as protrusion snow stop 200, having base 201, which is preferably generally planar, and snow restraining member 202 upstanding from the base 201. The base 200 has a bottom surface 203 having a downwardly directed, three-dimensional protrusion 210. A generally orthogonal surface 215 with respect to the bottom surface of the base 203 may be present in the protrusion 210. Preferably, a generally orthogonal surface 215 is provided so as to present it to face away from the upward portion of the roofing 100 when installed. Thus, such an orthogonal surface 215 could face the generally orthogonal surface 115 to provide for a secure brace for installing the snow stop 200 in recess 112 and/or sawtooth pattern(s) such as patterns 113 and 114. As an alternative, an acutely angled surface 216 with respect to the bottom surface of the base 203 may be present in the protrusion 210. Preferably, an acutely angled surface 216 is provided so as to present it to face away from the upward portion of the roofing 100 when installed. Thus, such an acutely angled surface 216 could face the acutely angled surface 116 to provide for a very secure brace for installing the snow stop 200 in recess 112.

Accordingly, typical shear forces may be eliminated. Moreover, by providing such protrusions 210, an additional element of shear resistance is provided the adhesive 60 in combating lift of the snow stop 200 by peel (P). This additional element of shear resistance is provided between the surfaces 115 & 215 or 116 & 216.

If only one such protrusion 210 is present, it is not a hook like protrusion extending from a front portion of the base. Compare, for example, Kwiatkowski et al., FIG. 3.

Also, the snow stop of the invention may have a forwardly directed wedge 220. Through the wedge 220, moving snow and ice may help push down on a front portion of the base 201 and perhaps help alleviate disengagement of installed snow stop 200, for example, as by peel forces (P).

The snow stop of the invention may be made of any suitable material, to include of suitable plastic(s), fiber reinforced plastic composite(s), and suitable metal(s). Preferably, the snow stop is of metal, especially of brass or aluminum.

The snow stop of the invention may be made by any suitable method, to include by known methods, to include by molding, casting, forging, shaping, milling, bending, pressing, and stamping. Preferably, the snow stop is molded or cast, especially cast of aluminum.

In applying the snow stop roofing of the invention, for example, prepared roofing panels or sheets 100 are applied to roofing substrate 50, which may be of steel and/or wood, for example, wood, and have insulation 51 applied (noting insulation typically applied under the substrate with known roofing materials installation, in comparison to FIG. 1) as well, by any suitable method, to include methods known in the construction art such as nailing, stapling, screwing, wedging, clipping, gluing, and so forth. The snow stop, to include the snow stops 40, 90 & 200, may be applied to the sheet surface 101 at suitable location(s) by the three dimensional feature(s) 110 by any suitable method, to include gluing as with adhesive 60.

The snow stop roofing of the invention provides for secure and simple snow slippage control. Too, snow stops applied to the snow stop roofing of the invention can be significantly more securely fastened than heretofore known.

CONCLUSION

The present invention is thus provided. Numerous modifications can be effected within its spirit, the literal claim scope of which is particularly pointed out as follows:

We claim:

1. A roofing system comprising a sheet with a sheet surface having a major plane extending transversely and longitudinally, and which may include standing or batten ridges extending longitudinally so as to define longitudinally directed ridges oriented in a direction corresponding to a direction in which rain, snow or ice would flow owing to a force of gravity when the sheet is installed as part of a roof, wherein the sheet surface has a predetermined arrangement of three dimensional features, which include sawtooth features, in addition to the standing or batten ridges, wherein the arrangement of the three dimensional features is predetermined to help support a snow stop and wherein the sawtooth features include a set of a plurality of transversely spanning features generally orthogonal to the direction in which rain, snow or ice would flow owing to the force of gravity, being at least one of A) above a major plane of the sheet surface, B) below the major plane of the sheet surface, and C) above and below the major plane of the sheet surface, extending transversely in a pattern a minor distance compared to a total distance the sheet extends in the transverse direction about a distance corresponding to a transverse width of a snow stop, wherein the sawtooth features in the set of transversely spanning features are substantially parallel and close to one another and wherein each required sawtooth feature has a sawtooth feature surface extending transversely the minor distance at an angle at least one of generally orthogonal and acutely angled to the major plane of the sheet surface, so as to present the sawtooth feature surface to face the direction in which rain, snow or ice would flow owing to the force of gravity when the sheet is installed as part of a roof; which sheet is useful with and adapted for particular snow stop embodiments in which the three dimensional sawtooth features of the sheet surface are capable of receiving corresponding three dimensional protrusions of a bottom surface of a base of a snow stop, wherein the snow stop includes the base having the transverse width and a snow restraining member upstanding from the base, which member has a snow restraining surface that will face the direction in which rain, snow or ice would flow owing to the force of gravity when the snow stop is installed as part of the roofing system, wherein the base has the bottom surface which has downwardly directed, three-dimensional sawtooth protrusions extending in the direction of the transverse Width of the base, wherein protrusion sawtooth surfaces which face in a direction opposite to the snow restraining surface are angled at an angle which is from generally orthogonal to acute in relation to the bottom surface of the base.

2. The roofing system of claim 1, wherein the sheet is of aluminum or metal.

3. The roofing system of claim 2, wherein standing seams are present.

4. The roofing system of claim 2, wherein the three dimensional features also include raised features.

5. The roofing system of claim 2, wherein the three dimensional features include the sawtooth features with the set of a plurality of transversely spanning features generally orthogonal to the direction in which rain, snow or ice would flow owing to the force of gravity, below the major plane of the sheet surface.

6. The roofing system of claim 5, wherein the three dimensional features include the sawtooth features wherein each required sawtooth feature has the sawtooth feature surface extending transversely the minor distance at an angle generally orthogonal to the major plane of the sheet surface.

7. The roofing system of claim 5, wherein the three dimensional features include the sawtooth features wherein each required sawtooth feature has the sawtooth feature surface extending transversely the minor distance at an angle acutely angled to the major plane of the sheet surface.

8. The roofing system of claim 2 wherein the three dimensional features include the sawtooth features with the set of a plurality of transversely spanning features generally orthogonal to the direction in which rain, snow or ice would flow owing to the force of gravity, above and below the major plane of the sheet surface.

9. The roofing system of claim 8, wherein the three dimensional features include the sawtooth features wherein each required sawtooth feature has the sawtooth feature surface extending transversely the minor distance at an angle generally orthogonal to the major plane of the sheet surface.

10. The roofing system of claim 8, wherein the three dimensional features include the sawtooth features wherein each required sawtooth feature has the sawtooth feature surface extending transversely the minor distance at an angle acutely angled to the major plane of the sheet surface.

11. The roofing system of claim 1, wherein the three dimensional features include the sawtooth features wherein each required sawtooth feature has the sawtooth feature surface extending transversely the minor distance at an angle generally orthogonal to the major plane of the sheet surface.

12. The roofing system of claim 1, wherein the three dimensional features include the sawtooth features wherein each required sawtooth feature has the sawtooth feature surface extending transversely the minor distance at an angle acutely angled to the major plane of the sheet surface.

* * * * *